US006004153A

United States Patent [19]

Myer et al.

[11] Patent Number: 6,004,153

[45] Date of Patent: Dec. 21, 1999

[54] ELECTRICAL CONNECTOR WITH CONNECTOR POSITION ASSURANCE DEVICE

[75] Inventors: John Mark Myer, Millersville; John Raymond Shuey, Mechanicsburg, both of Pa.

[73] Assignee: The Whitaker Corporation, Wilmington, Del.

[21] Appl. No.: 08/622,227

[22] Filed: Mar. 27, 1996

[51] Int. Cl.[6] ..... H01R 13/627

[52] U.S. Cl. ..... 439/352; 439/489

[58] Field of Search ..... 439/345, 350–358, 439/488, 489, 347

[56] References Cited

U.S. PATENT DOCUMENTS

| | | | |
|---|---|---|---|
| 4,370,013 | 1/1983 | Niitsu et al. . | |
| 4,634,204 | 1/1987 | Detter et al. . | |
| 4,708,413 | 11/1987 | Schroeder | 439/358 |
| 4,711,511 | 12/1987 | Noorily | 439/347 |
| 4,746,306 | 5/1988 | Yurtin et al. | 439/357 |
| 4,946,395 | 8/1990 | Cope et al. | 439/352 |
| 4,946,404 | 8/1990 | Takenouchi et al. | 439/352 |
| 4,950,179 | 8/1990 | Takenouchi et al. | 439/352 |
| 4,993,967 | 2/1991 | Matsumoto | 439/489 |
| 5,026,298 | 6/1991 | Brussalis et al. | 439/358 |
| 5,066,244 | 11/1991 | Kato et al. | 439/489 |
| 5,120,255 | 6/1992 | Kouda et al. | 439/489 |
| 5,131,865 | 7/1992 | Taguchi et al. | 439/489 |
| 5,163,848 | 11/1992 | Maeda et al. | 439/489 |
| 5,292,258 | 3/1994 | Sakurai | 439/352 |
| 5,330,366 | 7/1994 | Tsuji et al. | 439/352 |
| 5,348,493 | 9/1994 | Power | 439/352 |
| 5,370,550 | 12/1994 | Alwine et al. | 439/352 |
| 5,588,875 | 12/1996 | Sawada | 439/352 |
| 5,605,471 | 2/1997 | Plyler | 439/352 |
| 5,605,472 | 2/1997 | Sakai et al. | 439/489 |
| 5,624,271 | 4/1997 | Childs et al. | 439/352 |
| 5,643,003 | 7/1997 | Myer et al. | 439/352 |

OTHER PUBLICATIONS

Patent Abstracts of Japan; vol. 095, No. 010; Nov. 30, 1995 & JP 07 192808 A (Yazaki Corp), Jul. 28, 1995.

PCT International Search Report; Applicant's agent 16562 PCT; International application No. PCT/US 97/04224; International filing date Mar. 18, 1997; pp. 1–3.

*Primary Examiner*—Hien Vu

[57] ABSTRACT

An electrical connector assembly (10) comprising a housing (20) with a latch arm (30), a CPA (40) received in the latch arm (30), an inner housing (50) received within the housing (20), a wire seal (60) disposed on the inner housing (50) and retained by a seal retainer (70) and posts (51); a wire cover (80), and a header housing (90). Wire seal (60) includes wire receiving slits (67) therein for advantageously receiving wires (17) during an insulation displacement type wire termination operation. CPA (40) is operative to assure the operator that the header (90) and housing (20) have been fully mated together and to prevent inadvertent separation of the housing (20) from the header (90).

26 Claims, 6 Drawing Sheets

Fig. 4
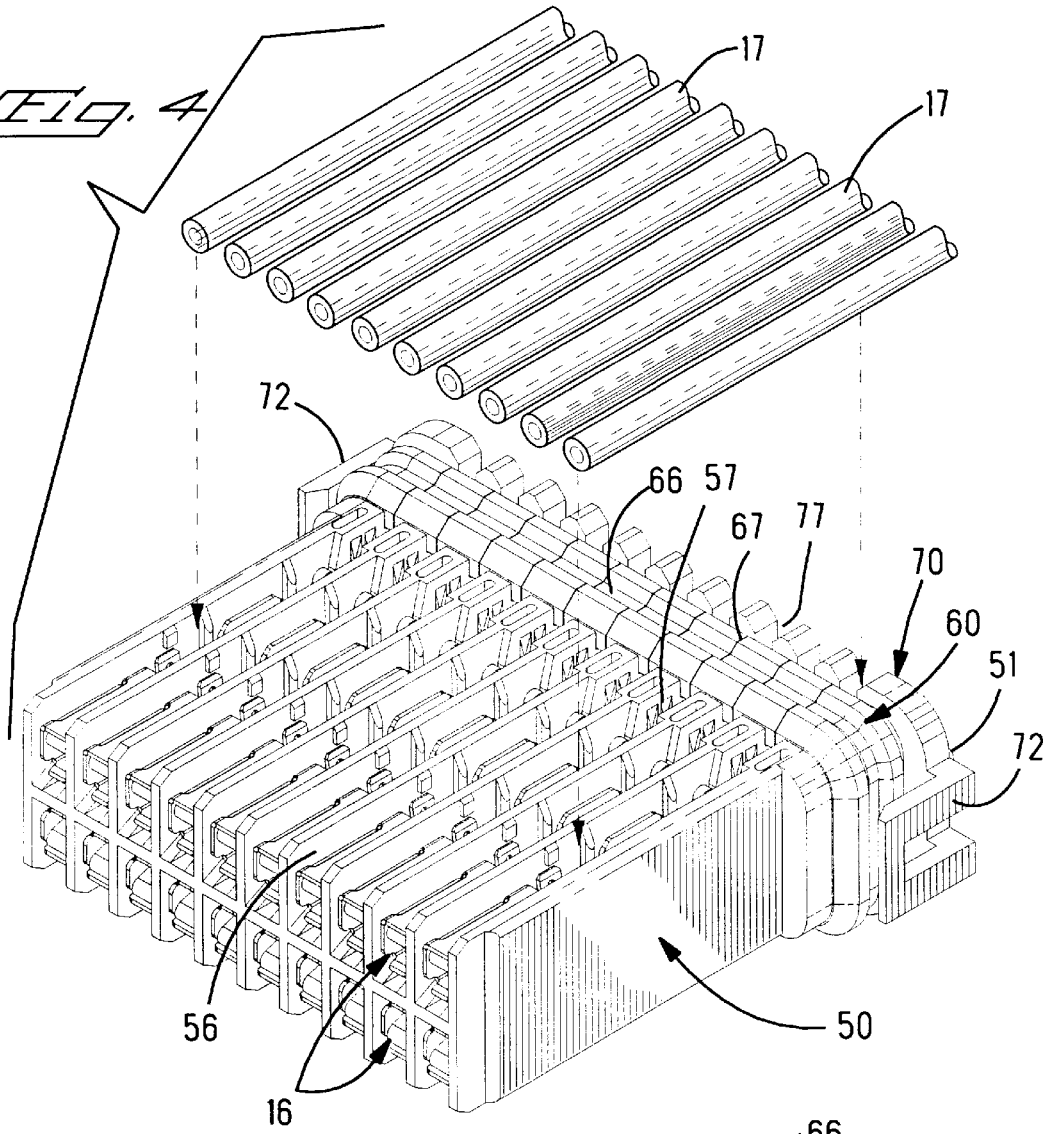
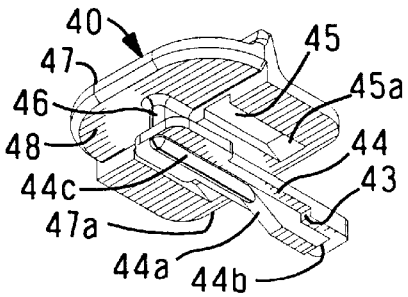
Fig. 2b
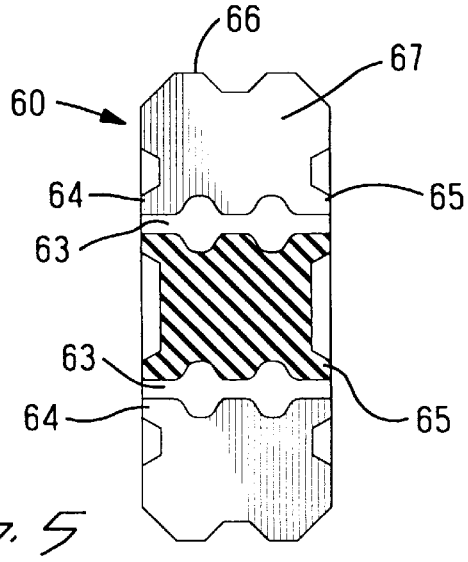
Fig. 5

ELECTRICAL CONNECTOR WITH CONNECTOR POSITION ASSURANCE DEVICE

The present invention relates to an electrical connector assembly comprising a connector position assurance (CPA) device disposed on a latchable housing thereof. In the performance of its function, the CPA cannot be advanced fully unless the housing has been fully mated to a matable connector; additionally, the CPA will prevent inadvertent unlatching of the housing.

BACKGROUND OF THE INVENTION

The CPA function of assuring an operator that the matable connector halves have been mated is particularly advantageous on an assembly line where the operator must make connections quickly and be certain that electrical connections are, in fact, made. Additionally, a CPA should be of a compact size, and must eliminate the risk of inadvertent separation of the connector halves by securely preventing deflection of any latches used to maintain the mated condition. The foregoing features are important to the automotive industry, where reliability of the electrical system's connections is essential, and material and labor costs are to be minimized.

A known CPA is disclosed in U.S. Pat. No. 4,634,204. This known connector device provides electrical terminals having matable male and female connector halves, one of which has a resilient, extended lock arm means for locking behind a lock bar of a sized window of the complementary connector half. When the two connector halves are mated, a CPA and an assist device are inserted axially along a track slot. The CPA device includes releasable, resilient lock tab means to retain it in operative engagement with the connectors. This known CPA is designed to provide a means of assuring that the male and female connectors have been fully mated. However, this known device is not readily adaptable to plug housings which include a deflectable latching arm that the operator deflects with his hand or finger. Moreover, once the CPA is fully advanced into its final position, the operator must use a tool to deflect a latching section of the CPA so that the CPA can be retracted and the connector halves can be separated. Additionally, the CPA must be maintained as a separate part from the plug housing until the plug and header have been fully mated such that the CPA cannot be in its fully advanced position relative to the plug housing when this housing is being mated with the header.

SUMMARY OF THE INVENTION

The forgoing problems are solved by the present invention which provides an electrical connector assembly comprising a connector housing with a deflectable latch thereon, the latch comprises a space for slidably receiving a CPA, a CPA member slidably disposed in the latch space between prelatch and latch positions, and a matable connector for matable connection to the housing, whereby the matable connector comprises a latch projection for latching engagement with the housing latch for latching the housing and the matable connector together.

The CPA comprises a delectable beam, and the matable connector comprises a deflection member for slidably deflecting the beam between the latch and prelatch positions. The deflection member comprises a projection member for sliding engagement with the CPA, and the projection member comprises advance and retraction tapers for deflecting the beam section of the CPA as the CPA is moved between the latch and prelatch positions.

The CPA is assembled in a prelatch position on the housing prior to the housing being connected to the matable connector, and the CPA likewise comprises advance and retraction sliding surfaces for deflecting a portion of the CPA as the CPA is moved between the positions. Additionally, the CPA comprises at least one abutment which is moved out of alignment with a stop projection formed on the latch thereby allowing the CPA to be moved from the prelatch position to the latch position when the housing and matable connector are in a mated condition. Moreover, if the CPA is at the latch position on the housing latch, or the CPA is between the latch and prelatch positions on the latch, then a portion of the matable connector is operative to engage a portion of the CPA and push the CPA toward the prelatch position during mating of the header with the housing. Further, the latch position is characterized in that a portion of the CPA is arranged for interference with a bearing section of header so that the CPA is operative to engageably cooperate with the bearing section in resisting deflection of the housing latch.

BRIEF DESCRIPTION OF THE DRAWINGS

FIG. 2*b* is an isometric view of the CPA of the connector assembly.

FIG. 4 shows an isometric view of an inner housing and seal subassembly of the present invention with wires shown prior to termination with insulation displacement contacts in the inner housing.

FIG. 6 shows a cross sectional view of the assembly of FIG. 3 taken along line 6—6.

DETAILED DESCRIPTION OF THE INVENTION

Figure 1:
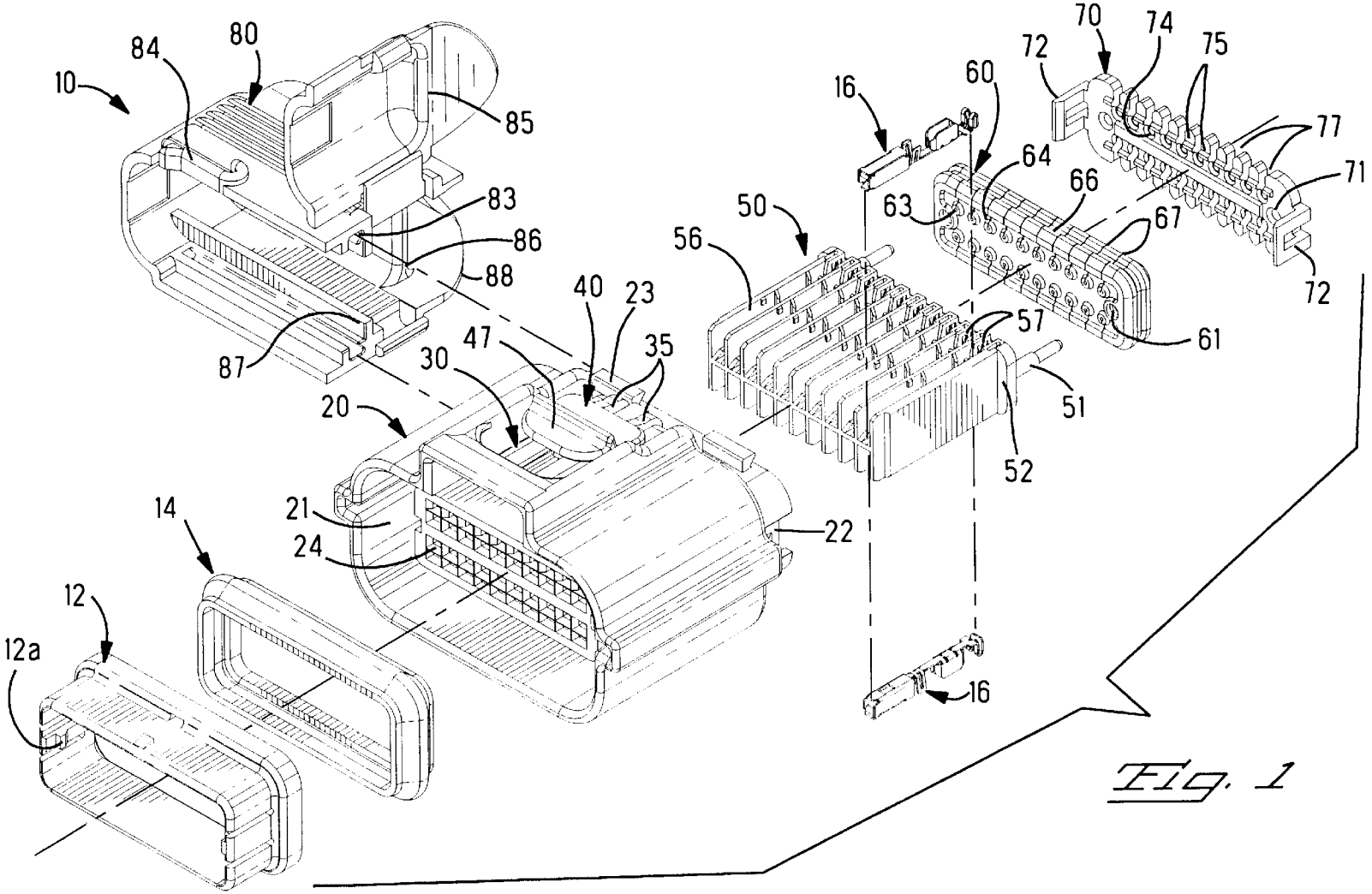
FIG. 1 is an exploded isometric view of an electrical connector assembly according to the present invention.

Referring to FIG. 1 a connector assembly 10 according to the present invention will be described. Connector assembly 10 comprises a housing 20 with a latch arm 30 formed thereon, a connector position assurance device (CPA) 40, an inner housing 50, a wire seal 60, a seal retainer 70, a wire cover 80, and a header housing 90 (shown in FIGS. 7–10). Housing 20 includes a cavity 21 for receiving an interface seal 14 which is retained in cavity 21 by seal retaining shroud 12 which includes latching structure 12*a* for latching the seal retaining shroud 12 to the housing 20. Housing also includes contact receiving apertures 24 for receiving contacts 16 after they are assembled to housing 50. Additionally, housing 20 includes latching recesses 22 for receiving latches 72 of seal retainer 70, and includes lugs 23 for slidable connection with recesses 83 of wire cover 80. As shown in FIG. 6, housing 20 includes an inner housing receiving cavity 25 for receiving inner housing 50 therein.

Referring to FIGS. 1–3 and 6, the latch arm 30 of housing 20 includes a rail 31, grooves 32 for slidably receiving CPA 40, stop projections 33 for engagement with portions of connection position assurance device 40, a flexible connecting section 34 which flexibly connects latch arm 30 to housing 20, and prelatch bumps 35 for maintaining connection position assurance device 40 in a prelatch position relative to housing 20.

Again referring to FIGS. 1–3 and 6, CPA 40 will be more fully described. CPA 40 includes: flanges 42 for slidable disposition in grooves 32 of latch arm 30; stop abutments 43 for cooperating with stop projections 33 of latch arm 30 thereby controlling the motion of CPA 40; a deflectable beam 44 including an advance taper 44*a*, a retraction taper 44*b*, and a rib 44*c*; prelatch grooves 45 having tapers 45*a* for maintaining the CPA in a prelatch position relative to housing 20; a flexible support section 46; an operating section 47 which is connected to flanges 42 through support section 46 and which includes a back edge 47*a*; and a bearing surface 48 for engaging a portion of header housing 90.

Now referring to FIGS. 1, 4, and 6 inner housing 50 will be described. Inner housing 50 includes: posts 51 which are configured to extend through corresponding apertures in seal 60 and seal retainer 70; latching shoulders 52 for cooperating with latches 72 of seal retainer 70 (as will be further described below); ribs 54 for cooperating with wire seal 60 (see FIG. 6); contact receiving cavities 56 for receiving contacts 16 therein; and wire receiving sections 57 for retaining wires 17 in the housing.

Referring to FIGS. 1 and 4–6, wire seal 60 includes: post receiving apertures 61 for receiving posts 51 of inner housing 50; wire receiving apertures 63 having undulated surfaces for receiving wires 17 (see FIG. 4); frusto-conical sections 64 and 65 for cooperating with corresponding structure 54 and 75 of inner housing 50 and seal retainer 70, respectively; outer undulated rib surface 66 for providing sealing between the inner housing 50 and housing 20; and wire receiving slits 67 associated with wire receiving apertures 63 for receiving wires 17 therein, as will be further described below.

Referring to FIGS. 1, 4 and 6, seal retainer 70 includes: post receiving holes 71 for receiving posts 51 therein; latches 72 for latching to latch recesses 22 of housing 20; recesses 74 for receiving frusto-conical sections 65 of wire seal 60; ribs 75 for cooperating with frusto-conical sections 65 of wire seal 60; and wire slots 77 for receiving wires 17 after termination with contacts 16.

Referring to FIGS. 1–3, and 6, wire cover 80 includes: lug receiving grooves 83; a latch 84 for latching the wire cover 80 to housing 20; a hinged door 85 for closing the cover after wires 17 have been laced around inner wall 86; and abutment flanges 87 for engaging seal retainer 70 when the wire cover is mounted onto housing 20.

FIGS. 7–10 show the header housing 90 according to the present invention. Header housing 90 includes: a latch projection 91 for latching connection to rail 31 of latch arm 30; a deflection member 94 with an advance taper 94*a* and a retraction taper 94*b*; a slot 96 for receiving support section 46 of CPA 40; and a recess 97 having bearing plates 98 therein for engagement with bearing plate 48 of CPA 40.

Figure 5:
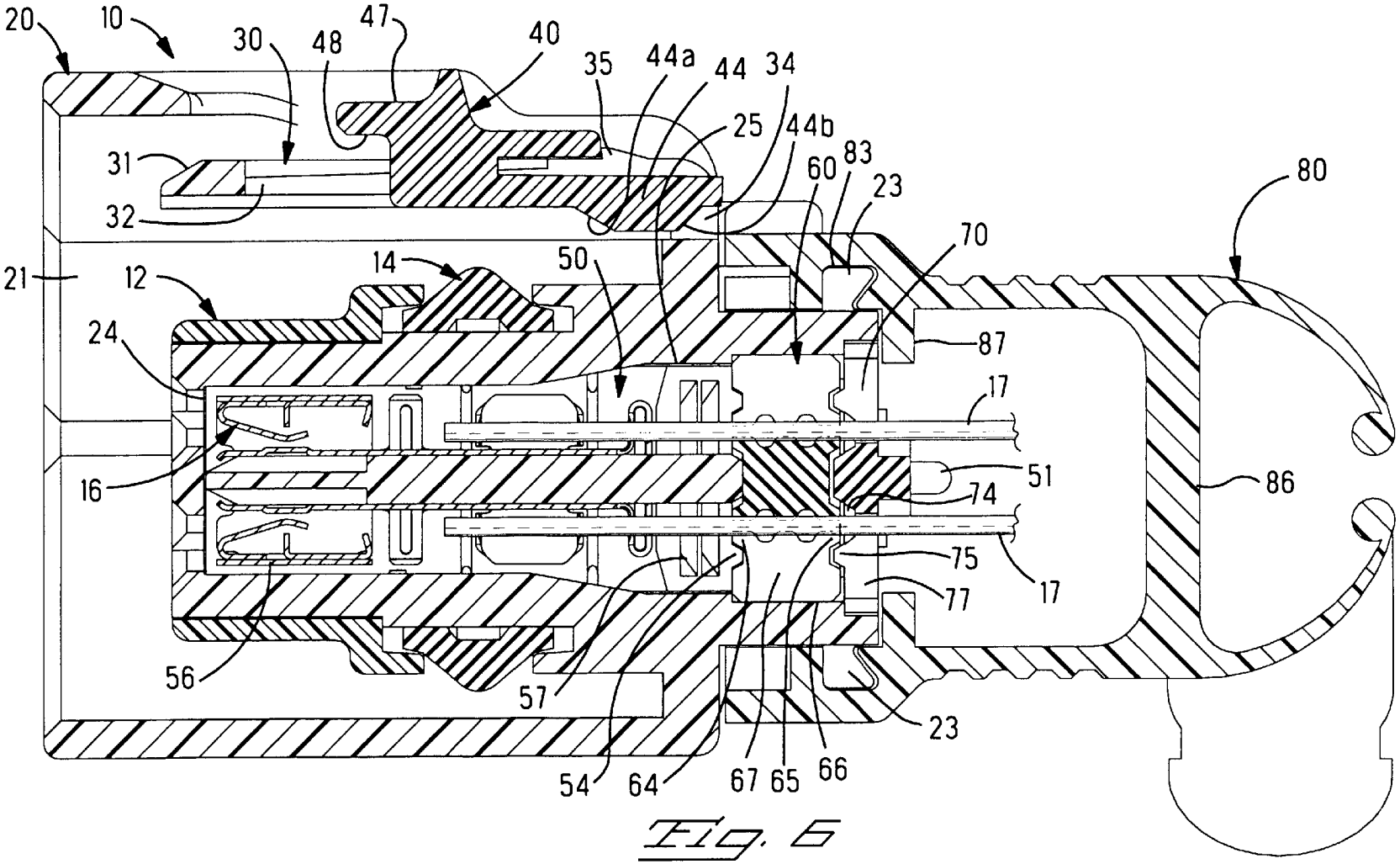
FIG. 5 shows a cross section of the seal of FIG. 1.

Referring now to FIGS. 4–6, the sealing aspects of the present invention will be described. First, the seal 60 is mounted to inner housing 50 such that posts 51 will be inserted into respective post receiving apertures 61 of seal 60, and the retainer 70 will then be pressed on the seal so that posts 51 will protrude through respective apertures 71 of retainer 70. At this point, posts 51 are heat-staked and they will firmly retain seal retainer 70 against seal 60 so that seal 60 is sealingly disposed between inner housing 50 and seal retainer 70. Posts 51 can comprise cross sections other than circular. Any elongated member suitable for heat-staking and use with seal 60 can form posts 51.

Next, the contacts 16 are assembled to inner housing 50, and inner housing 50 is assembled to connector housing 20 by insertion into cavity 25 thereof so that insulation displacement sections of contacts 16 are exposed for receipt of wires 17. Wires 17 are insulation displacement terminated with contacts 16. As the termination step occurs, insulated portions of wires 17 will displace portions of seal 60 as the wires are pressed through respective slits 67 of seal 60. Thus wires 17 will be terminated into respective contacts 16, the wires will pass through respective wire apertures 63 of seal 60, and will be received in respective wire slots 77 of retainer 70. It is important to note that any slit 67 can be offset at an angle relative to a respective aperture 63, and/or the surfaces of any slit 67 can be profiled, e.g. convoluted, undulated, a wave form, saw-tooth, dimpled, etc. without departing from the scope of the appended claims.

As the subassembly defined by inner housing 50, seal 60, and retainer 70 is inserted into housing 20 at cavity 25, latches 72 will latchably engage latching recesses 22 of housing 20 and inner housing 50 is thereby firmly connected to housing 20. At this point, the wires 17 extend from retainer 70, and wire cover 80 is installed on housing 20 so that lugs 23 will be slidably disposed in recesses 83 of cover 80. Wires 17 will be dressed around inner wall 86 of wire cover 80 and laced through flexible walls 88 of the wire cover thereby providing additional strain relief to the wires. FIG. 6 shows the assembly of wire cover 80 to housing 20 with retainer 70 pressing against seal 60, which seal is trapped between inner housing 50 and retainer 70. Ribbed outer surface 66 of seal 60, as shown in FIG. 5, is shown flattened against the cavity wall of cavity 25 in FIG. 6, this causes the seal material to flow so that a primary constriction of undulated surfaces in apertures 63 occurs resulting in sealing pressure against wires 17. Moreover, the seal can be treated with a gel material to enhance its sealing performance.

In an advantage of the invention, wires 17 will be sealingly disposed in the assembly 10 such that fluid pressures acting on the seal 60 will force frusto-conical sections 65 into frusto-conical recesses 74 of retainer 70, and sections 65 will thereby be further constricted against the wires 17. On the opposed side of seal 60, the frusto-conical sections 64, when pressed into engagement with ribs 54 of inner housing 50, will likewise be constricted against wire 17 thereby providing excellent sealing of the wires in the connector assembly 10.

Figure 2A:
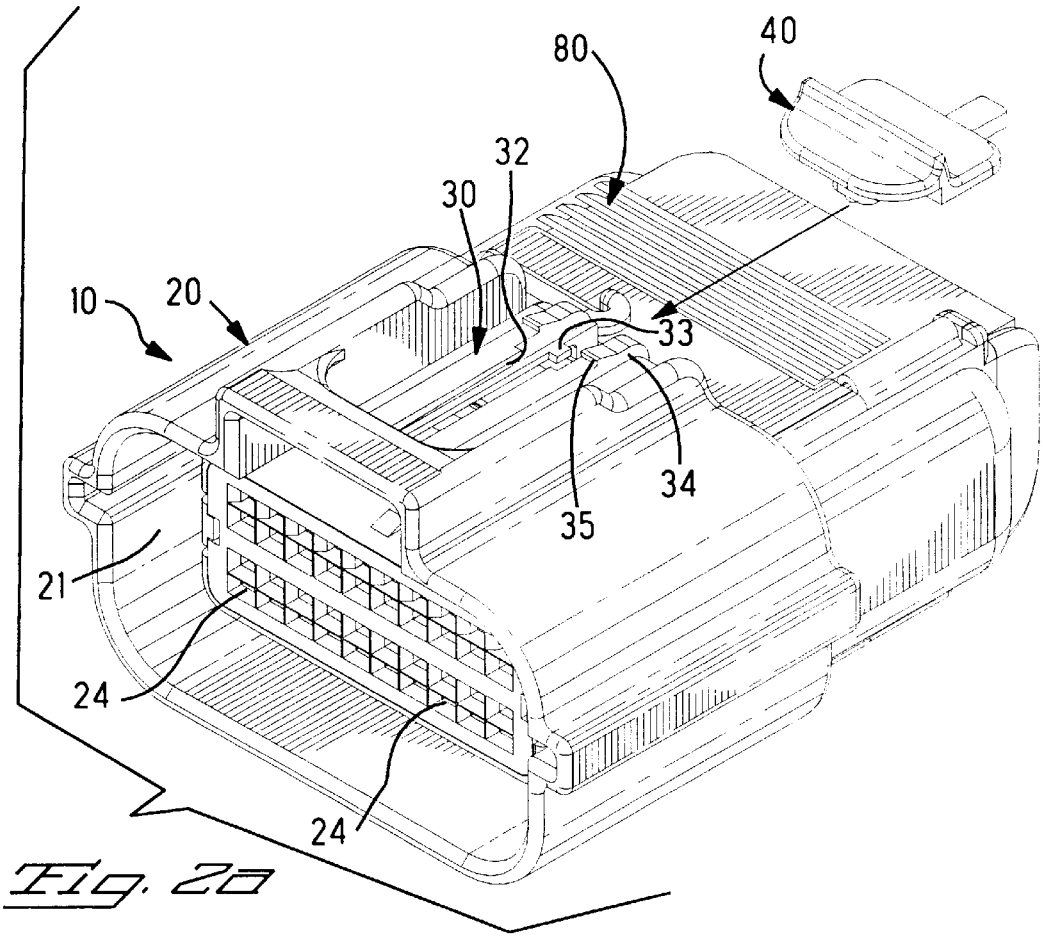
FIG. 2*a* is an assembly view of the connector assembly of FIG. 1 with an inset drawing of the connector position assurance device of the present invention.
Figure 3:
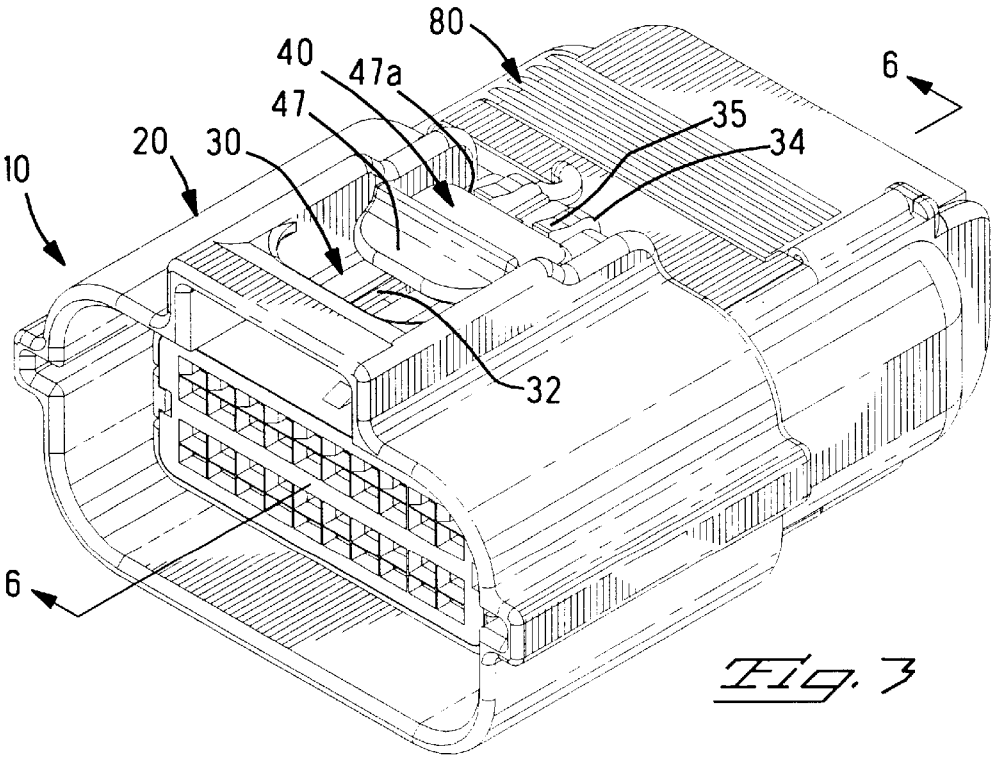
FIG. 3 is an isometric view of the assembly of FIG. 2 with the connector position assurance device installed on the connector assembly.

Now referring to FIGS. 2 and 6, the assembly of CPA 40 onto housing 20 will be described. FIG. 2 shows the CPA 40 exploded away from housing 20; CPA 40 is aligned with latch 30 and is to be pressed into positive engagement therewith in a prelatch position. The prelatch position of CPA 40 requires prelatch bumps 35 of latch 30 to be slid into prelatch grooves 45 of CPA 40. Tapers 45*a* thereof will slidably engage the tapers of prelatch bumps 35 and will thereby resiliently deflect the operating section 47 of CPA 40 upwardly so that the CPA can be advanced toward the mating face of housing 20. When the CPA 40 has been advanced toward the mating face, operating section 47 will resile downwardly in a snapping action so that back edge 47*a* of operating section 47 will be disposed against prelatch bumps 35.

Flange 42 of CPA 40 is slidably disposed in grooves 32 of latch 30 when the back edge 47*a* is engaged with prelatch bumps 35; however, stop abutments 43 will be engaged with stop projections 33 of latch 30 when CPA 40 is in the prelatch position. Thus, CPA 40 is positively trapped on latch 30 between prelatch bumps 35 and stop projections 33. In this prelatch position, the CPA 40 cannot be further advanced toward the mating face of housing 20.

Figure 7:
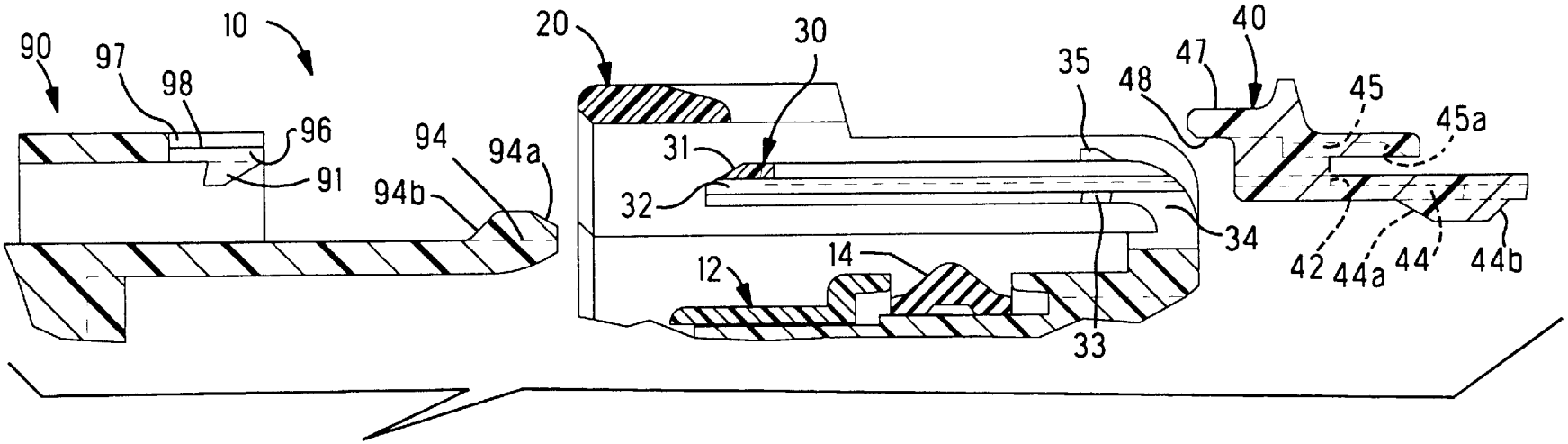
FIG. 7 shows a cross sectional, pre-assembly view of the connector assembly with a header.
Figure 8:
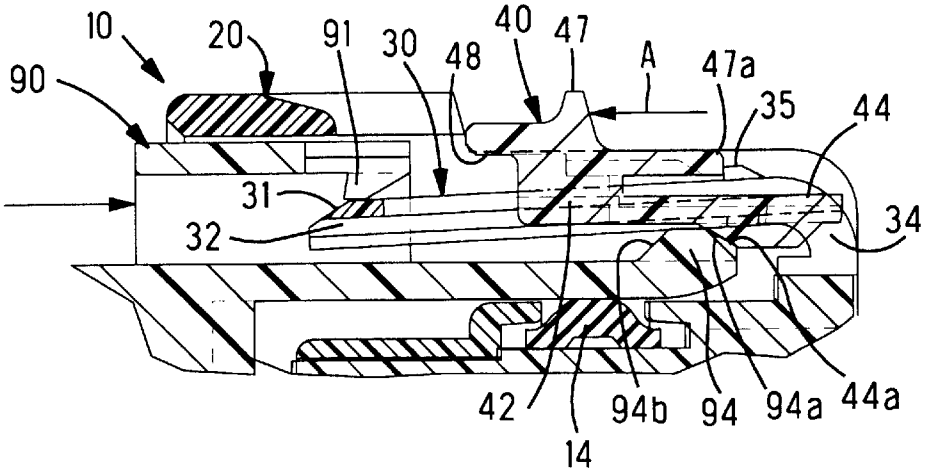
FIG. 8 shows the connector housing, header, and connector position assurance device in a prelatched position.

Now referring to FIGS. 7–10, operation and interaction of the housing 20, CPA 40 in the aforementioned prelatch position, and header 90 will be described. As shown in FIG. 7, housing 90 is aligned for engagement with housing 20 so that deflection member 94 will be inserted below latch 30; and latch projection 91 will be disposed above latch 30 and will engage rail 31 and deflect the latch 30 as shown in FIG. 8. At this point, advance taper 94*a* of deflection member 94 will engage advance taper 44*a* of beam 44 thereby deflecting beam 44. When beam 44 is deflected as shown in FIG. 8, stop abutments 43 will begin to be lifted away from engagement with stop projections 33 of latch 30.

Figure 9:
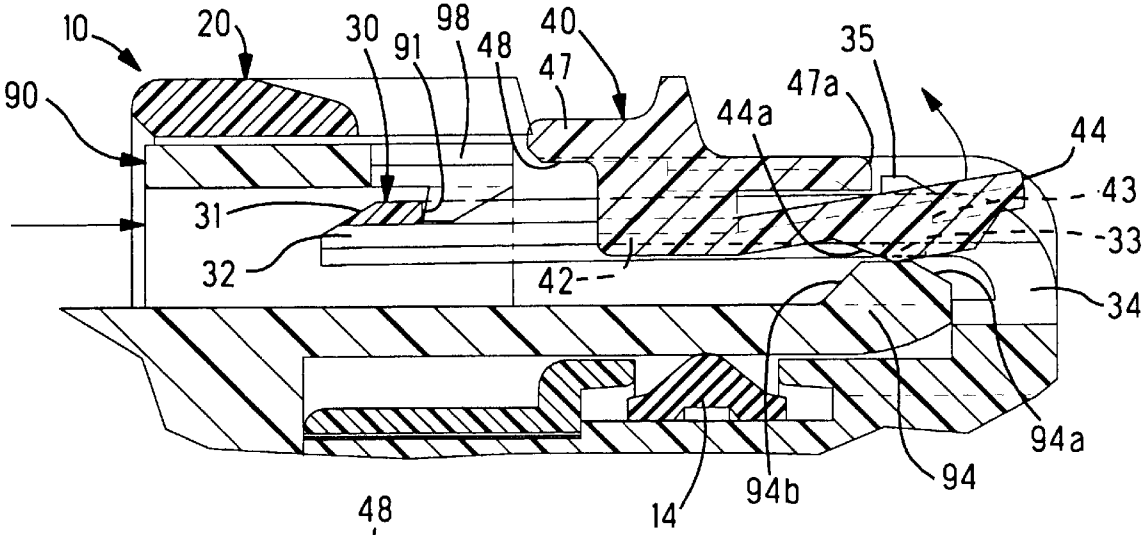
FIG. 9 shows the connector position assurance device in engagement with a portion of the header but prior to full advancement of the connector position assurance device relative to the assembly.

FIG. 9 shows that latch 30 has resiled upwardly so that rail 31 is in positive latching engagement with latch projection 91 of header 90. Beam 44 of CPA 40 has been fully deflected upwardly, and, because stop abutments 43 are now fully clear of engagement with stop projections 33 of latch 30, the CPA 40 is free to be advanced toward the mating face of housing 20 in the direction of arrow A of FIG. 8.

Figure 10:
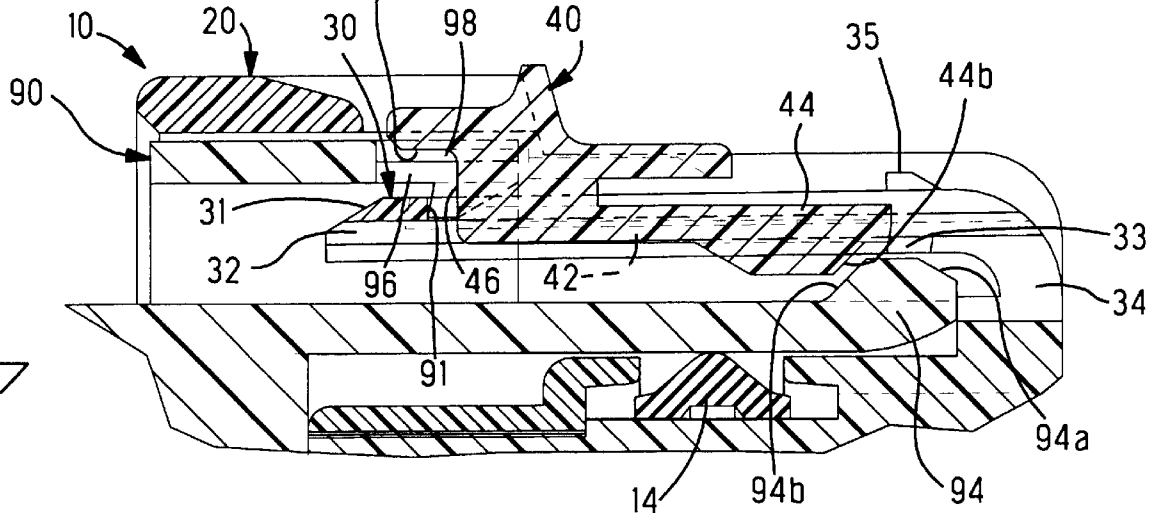
FIG. 10 shows the of the present invention in its final position on the assembly.

FIG. 10 shows the fully advanced state of CPA 40 wherein: support section 46 of CPA 40 has been pushed into slot 96 of header 90; bearing surface 48 of CPA 40 is disposed for bearing engagement with bearing plates 98 adjacent to slot 96 of header 90; and operating section 47 of CPA 40 is disposed in recess 97 of header 90. In this latched position, the latch 30 cannot be deflected because the operator cannot displace CPA 40, as bearing surface 48 and bearing plate 98 of header 90 will prevent any downward deflection of latch 30. Flanges 42 of CPA 40 are still slidably disposed in grooves 32 so that any upward movement of CPA 40 will necessarily cause rail 31 to abut header 90 adjacent to recess 97. Thus the header 90 and housing 20 are latched together with CPA 40 preventing any inadvertent deflection of the latch 30. Moreover, it is important to note that CPA 40 cannot be advanced from the prelatch position until the header 90 and housing 20 have been fully mated together. As discussed more fully below, if the CPA 40 is disposed between the latch and prelatch positions prior to mating of housing 20 with header housing 90, a portion of header 90 adjacent recess 97 will engage and push the CPA toward the prelatch position while the mating of housings 20,90 takes place.

To remove the header 90 from housing 20, the operator will retract CPA 40 by pressing on operating section 47 to force CPA 40 away from the mating face of housing 20. As this occurs, retraction taper 44*b* of beam 44 will be pressed into engagement with retraction taper 94*b* of deflection member 94 so that beam 44 will be deflected upwardly. When beam 44 has been so deflected, the end of beam 44 will be deflected away from stopping engagement with stop projections 33 of latch arm 30, thereby fully clearing the stop projections 33 so that the CPA 40 can be fully retracted.

Moreover, in a further advantage of the invention, when the CPA 40 is in an intermediate position between the prelatch and latch positions on latch arm 30, the latch arm 30 will be deflected down (as shown in FIG. 8) as the header 90 mates with housing 20, and a portion of header 90 will engage a portion of bearing surface 48 thereby pushing the CPA 40, relative to latch arm 30, to the prelatch position. This is an advantage where, for example, the CPA 40 has been inadvertently dislodged from its prelatch position during shipping or handling of the assembly 20,40 on an assembly line.

Thus, while a preferred embodiment of the invention has been disclosed, it is to be understood that the invention is not strictly limited to such embodiment but may be otherwise variously embodied and practiced within the scope of the appended claims. For example, it is contemplated that the connector assembly 10 can be adapted for use with crimped terminals inserted into the inner housing 50. Additionally, the slits 67 can be widened to the point of forming slots in the seal prior to complete assembly. Moreover, the rows of wire receiving aperture 63 can be staggered so that slits 67 can extend away from the apertures in substantially the same direction, for example, where the seal 60 comprises one or more rows of apertures 61. Furthermore, although the CPA 40 has been shown with flanges 42 for slidable movement in grooves 32 of latch arm 30, it is contemplated that the latch arm 30, conversely, can be adapted to include projections or flanges which would be slidable in grooves or recesses formed on the CPA 40.

Accordingly. what is claimed is:

1. An electrical connector assembly which includes a header, a connector position assurance device, and a connector housing with at least one contact receiving aperture therein which extends from a mating face of said housing, a deflectable housing latch arm formed on said connector housing for latching the connector housing to the header, said latch arm deflecting during mating of the connector housing to the header, said housing latch arm haiing a beam with at least one space formed therein for slidably receiving a portion of said connector position assurance device, said connector position assurance device is slidably movable in said space between first and second positions relative to said housing latch arm, said connector position assurance device being mounted upon the latch arm, wherein upon deflection of the latch arm, the connector position assurance device is deflected with the latch arm when the connector position assurance device is in the first position, said header includes a projection for engaging a deflectable portion of the connector position assurance device, whereby when said connector position assurance device is in said first position, said header projection is positioned to deflect the deflectable portion, wherein said first position is characterized in that said deflectable portion of said connector position assurance device has an abutment which is aligned for engagement with a stop projection formed on said housing latch arm and, wherein said housing latch arm has prelatch bumps adjacent to a support section of said connector position assurance device and said connector position assurance device is trapped between said abutment and said prelatch bumps, whereby said deflectable portion is deflected above said projection by said projection as the connector position assurance device is moved to the second position.

2. The assembly of claim 1, wherein when said connector position assurance device is in said second position an operating section of said connector position assurance device is disposed above at least one plate formed on the header and connected to a latching section of the header, and said second position thereby prevents inadvertent withdrawal of said housing from said header.

3. The assembly of claim 1, wherein the deflectable portion of said connector position assurance device is deflectable into defining an obtuse angle when said connector position assurance device is in said first position.

4. The assembly of claim 1, wherein said second position is characterized in that said deflectable portion comprises an end section of said connector position assurance device which is aligned for engagement with a front side of at least one stop projection formed on said housing latch arm.

5. The assembly of claim 4, wherein said connector position assurance device is trapped between said stop projection and a rail member formed on said connector position assurance device, whereby said deflectable portion is deflected above said projection as the connector position assurance device is moved to the first position.

6. The assembly of claim 4, wherein said connector position assurance device second position is further characterized by alignment of a support section of said connector position assurance device within a slot formed in said header.

7. An electrical connector assembly, the assembly comprises:

a first housing with a deflectable latch arm thereon for latching the first housing to a matable housing, the latch arm deflecting during mating of the first housing to the matable housing, and a connector position assurance device, wherein said first housing is operative to receive the connector position assurance device in prelatch and latched positions, the connector position assurance device being mounted on the latch arm, whereby upon deflection of said latch arm, the connector position assurance device deflects with the latch arm when the connector position assurance device is in the prelatch position, wherein the latch arm includes prelatch bumps for sliding engagement with the connector position assurance device and holding the connector position assurance device in the prelatch position.

8. The assembly of claim 7, wherein said deflectable latch arm comprises a space therein for slidably receiving the connector position assurance device, and said space is in communication with at least one groove formed in said latch arm, whereby when said latch arm is deflected said groove is therewith deflected.

9. The assembly of claim 8, wherein at least one stop projection extends into said space for engaging a respective abutment formed on said connector position assurance device in the prelatch position.

10. The assembly of claim 8, wherein the latch arm includes a groove therein for receiving the connector position assurance device which comprises a sliding member.

11. The assembly of claim 10, wherein the connector position assurance device sliding member comprises a flange.

12. The assembly of claim 8, wherein the latch arm comprises bumps which slidably deflect an operating section of the connector position assurance device when the connector position assurance device is initially assembled to the housing.

13. An electrical connector comprising:

a connector housing with a deflectable latch arm thereon, the latch arm deflecting during mating of the connector housing to a matable housing, said latch arm comprises a space for slidably receiving a connector position assurance device, a connector position assurance device slidably disposed in said latch space between prelatch and latch positions, the connector position assurance device being mounted to the latch arm, wherein upon deflection of the latch arm, the connector position assurance device is moved with the latch arm when the connector position assurance device is in the prelatch position; and wherein the matable housing comprises a latch projection for latching engagement with said connector housing latch arm for latching the connector housing and the matable housing together, and wherein said connector position assurance device comprises advance and retraction tapered sliding surfaces for deflecting a portion of said connector position assurance device as the connector position assurance device is moved between said prelatch and said latch positions.

14. The assembly of claim 13, wherein said connector position assurance device comprises a delectable beam.

15. The assembly of claim 14, wherein said matable connector comprises a deflection member for slidably deflecting said beam as said connector position assurance device moves between said prelatch and said latch positions.

16. The assembly of claim 14, wherein said matable connector comprises a projection member for sliding engagement with said connector position assurance device.

17. The assembly of claim 16, wherein said projection member comprises advance and retraction tapers for deflecting the beam section of said connector position assurance device as said connector position assurance device is moved between said prelatch and said latch positions.

18. The assembly of claim 13, wherein said connector position assurance device is assembled in a prelatch position on said connector housing prior to said connector housing being connected to said matable housing.

19. An electrical connector assembly, comprising:

a connector housing with a deflectable latch arm thereon, said latch arm comprises a space for slidably receiving a connector position assurance device, a connector position assurance device received in said space and slidable between prelatch and latch positions, said connector position assurance device moving with said latch arm when said latch arm is deflected, a matable connector for matable connection to the housing, said matable connector comprises a latch section for latching engagement with said housing latch arm for latching the housing and the matable connector together, and as said housing and matable connector are being mated together said latch arm is deflected, and when said connector position assurance device is at the latch position on said latch arm, or the connector position assurance device is between said latch and prelatch positions on said latch arm, then a portion of said matable connector is operative to engage a portion of said connector position assurance device and push said connector position assurance device toward said prelatch position, wherein the latch arm includes prelatch bumps for sliding engagement with the connector position assurance device and holding the connector position assurance device in the prelatch position.

20. The connector assembly of claim 19, wherein a deflectable portion of said connector position assurance device is deflected by a portion of said matable connector as the connector position assurance device is moved toward the prelatch position.

21. The connector assembly of claim 19, wherein a portion of said connector position assurance device is moved out of alignment for engagement with a portion of said latch arm as the connector position assurance device is moved toward the prelatch position.

22. An electrical connector assembly, comprising:

a connector housing with a latch arm thereon, the latch arm deflecting during mating of the connector housing to a matable housing, said latch arm comprises a space for slidably receiving a connector position assurance device, a connector position assurance device slidably associated with said space between prelatch and latch positions relative to the latch arm, the connector position assurance device being mounted to the latch arm, upon deflection of the latch arm, the connector position assurance device is moved with the latch arm when the connector position assurance device is spaced from the latch position, a matable connector for matable connection to the housing, said matable connector comprises a latch section for latching engagement with said housing latch arm for latching the housing and the matable connector together, and the latch position is characterized in that a portion of said connector position assurance device is arranged for interference with a bearing section connected to the latch section of said matable connector so that said connector position assurance device is operative to engageably cooperate with said bearing section in resisting deflection of said housing latch arm.

23. The assembly of claim 22, wherein said bearing section comprises a space which receives a portion of said connector position assurance device therethrough.

24. The assembly of claim 22, wherein said bearing section comprises part of a recess of said matable connector.

25. The assembly of claim 22, wherein said connector position assurance device portion arranged for interference with said bearing section comprises an operating section of said connector position assurance device.

26. An electrical connector assembly, the assembly comprises:

a first housing with a deflectable latch arm thereon, the latch arm deflecting during mating of the first housing to a mating housing, and a connector position assurance device, wherein said housing is operative to receive the connector position assurance device in prelatch and latched positions, the latch arm having a space therein for slidably receiving the connector position assurance device, and said space is in communication with at least one groove formed in said latch arm, the latch arm having bumps which slidably deflect an operating section of the connector position assurance device when the connector position assurance device is initially assembled to the housing to retain the connector position assurance device on the latch arm, whereby when said latch arm is deflected said groove is therewith deflected.

* * * * *